United States Patent [19]

Van Der Park et al.

[11] Patent Number: 4,989,427

[45] Date of Patent: Feb. 5, 1991

[54] FLESHING MACHINE

[75] Inventors: Simon P. Van Der Park, Christchurch; Angus A. J. Robertson, Rangiora; David P. Cairns, Christchurch, all of New Zealand

[73] Assignee: Her Majesty the Queen in right of New Zealand, Christchurch, New Zealand

[21] Appl. No.: 240,135

[22] Filed: Sep. 2, 1988

[30] Foreign Application Priority Data

Sep. 7, 1987 [NZ] New Zealand ..... 221706

[51] Int. Cl.[5] ..... C14B 1/22

[52] U.S. Cl. ..... 69/37; 83/861; 83/870; 407/7; 407/9

[58] Field of Search ..... 69/37, 38, 39, 40, 41, 69/42, 43; 83/861, 870; 407/7, 8, 9, 10

[56] References Cited

U.S. PATENT DOCUMENTS

| | | | |
|---|---|---|---|
| 701,080 | 5/1902 | Perkins | 69/44 |
| 978,318 | 12/1910 | Marx | 69/44 |
| 1,055,717 | 3/1913 | Daniels | 69/37 X |
| 1,272,162 | 7/1918 | Whitney | 69/42 |
| 2,030,130 | 2/1936 | Whitney | 69/37 X |
| 2,380,517 | 7/1945 | Gordon | 407/8 X |

FOREIGN PATENT DOCUMENTS

| | | | |
|---|---|---|---|
| 166995 | 5/1965 | U.S.S.R. | 69/37 |
| 631315 | 11/1978 | U.S.S.R. | 407/10 |
| 774826 | 9/1980 | U.S.S.R. | 407/9 |

*Primary Examiner*—Wm. Carter Reynolds

*Attorney, Agent, or Firm*—Ross, Ross & Flavin

[57] ABSTRACT

A fleshing machine for removing fat and fleshy membranes from a hide or pelt, which includes a fixed position roller with many shaped cavities. Each cavity extends from an opening on the surface of the roller into the roller. A plurality of knives are contained one or more within each cavity. Each knife has a shaped cutting head which, in use, protrudes from the surface of the roller. The knives and cavities are so shaped that each knife is capable of limited reciprocal movement in a direction perpendicular to the axis of the roller.

21 Claims, 6 Drawing Sheets

FLESHING MACHINE

FIELD OF THE INVENTION

The present invention relates to an improved fleshing machine, i.e. a machine to remove fat and fleshy membranes from a pelt or hide, and in particular a sheep pelt.

DESCRIPTION OF THE PRIOR ART

Some known fleshing machines include sets of fixed-position horizontal rotating helical blades to remove fat and fleshy membranes from a pelt. On some machines only half a pelt can be treated to remove fat and membranes in one pass. Also, if a pelt has an uneven thickness due to matting on the reverse side, the fixed position blades tend to dig into the pelt and rip it or otherwise damage it. Where wool or hide on the reverse side of the pelt is naturally thinner (e.g. around the leg edges), fixed blades cannot effectively remove fat and membranes from these areas as they do not always fully contact the fixed position blades.

In New Zealand patent No: 217201 a fleshing machine is described wherein the fat and membranes are plucked from the pelt by a series of knives operated by a series of offset eccentric cams. The pelt is constantly subjected to a plucking motion that is gentler than any action of the above described known fleshing machines.

However the fleshing machine of New Zealand patent No: 217201 has disadvantages: the metal knives tend to wear out quickly; because the axis of rotation of the knives is fixed in spatial relationship to the pelt; there is insufficient flexibility to avoid small cuts to the pelt where the pelt is of an uneven thickness; and a blowing or sucking means is required to keep the pelt in a suitable position for the correct operation of the knives.

BRIEF SUMMARY OF THE INVENTION

An object of the present invention is the provision of an improved fleshing machine which overcomes the disadvantages of the fleshing machine in New Zealand No: 217201 and the disadvantage outlined above of earlier known fleshing machines. A further object of the present invention is the provision of an improved fleshing machine which is easy to keep clean whilst the machine is in operation.

Preferably, the axis of rotation of the fixed position roller is horizontal.

Preferably, the openings of the cavities on the surface of the roller are positioned in a plurality of lines of openings extending along the length of the roller; said lines being evenly spaced about the circumference of said roller surface.

Preferably the openings are slots, and are positioned such that the slots form a plurality of 'V' shaped lines, the base of the 'V' pointing in the direction of motion of the roller.

The slots may be shaped so that the direction of the major axis of each slot is substantially parallel with that of the axis of rotation of the roller. Preferably, the major axis of each slot is substantially parallel with the limb of the respective side of the V shape on which each said slot is positioned. Preferably also, the slots on each limb of each line of slots are contiguous so that each limb of the V shaped line provides one long cavity.

Where each V shaped line is comprised of two long slots, i.e. the two limbs of the V, each slot may contain one long knife, but preferably contains a plurality of knives. This is to facilitate the replacement of worn knives, and the plucking action of the knives on the pelt. Preferably also, each knife has a part-spiral twist along the axis substantially parallel to the edge of the shaped cutting head, for ease of placement of each knife within a cavity.

The present invention further provides an improved knife for a fleshing machine, said machine comprising:

a supporting means for supporting or holding a hide or pelt;

a roller which is a fixed position roller and which is capable of rotation about an axis, said roller containing a plurality of shaped cavities, each cavity extending from an opening on the surface of the roller into the roller;

driving means for rotating said roller about said axis;

means to produce relative movement between the hide or pelt and the roller;

a plurality of shaped knives; wherein the improvement comprises:

one or more knives being contained within each said cavity; each said knife having a shaped cutting head which in use protrudes from the surface of said roller, and a shank and a base such that each said knife is capable of limited reciprocal movement in a direction perpendicular to the axis of said roller, each said cavity being shaped so as to permit said limited movement of each knife and to retain the base of said knife within the cavity when said machine is in operation or stationary; and wherein the positioning and shape of the cavities within the roller and the shape of the knives are such that, in operation, the cutting head of each knife contacts the surface of said hide or pelt with an approximately constant force and at approximately a right angle to the surface of the hide or pelt as said surface passes said roller and such that each said cutting head is also capable of limited movement in a plane substantially perpendicular to the plane of reciprocal movement of said knife.

The cutting head of each knife is especially shaped, chamfered, tapered or notched, so as not to rip or tear the pelt.

Preferably, the roller and knives are made from a plastics material, or a lightweight metal e.g. steel or stainless steel. The weight of the material of the knives must be such that each knife does not contact the pelt with a force sufficient to damage the pelt, and such that the knives do not wear out at a unacceptably high rate.

Preferably, the invention further includes at least one spreader roller positioned parallel with the roller and in touching contact with the pelt, in order to spread out the pelt for ease of operation of the roller and knives on the pelt.

As the roller rotates the knives are thrown outward from the axis of rotation of the roller by centrifugal force. This motion, plus the limited movement of each knife in the plane substantially perpendicular to the plane of reciprocal movement of each said knife allows the knives to gently pluck any excess fat and membranes on the pelt. If a knife meets with an obstruction that cannot be plucked off (e.g. lumping of the pelt due to matting on the reverse side), it is forced back into the cavity. Once the knife is free of the obstruction, the centrifugal force causes the knife to move outward from the surface of the roller again.

In practice it has been found that the pelts or hides treated by the present invention to remove fat and fleshy membranes produce leather of very high quality when tanned by known means.

DETAILED DESCRIPTION

Figure 1:
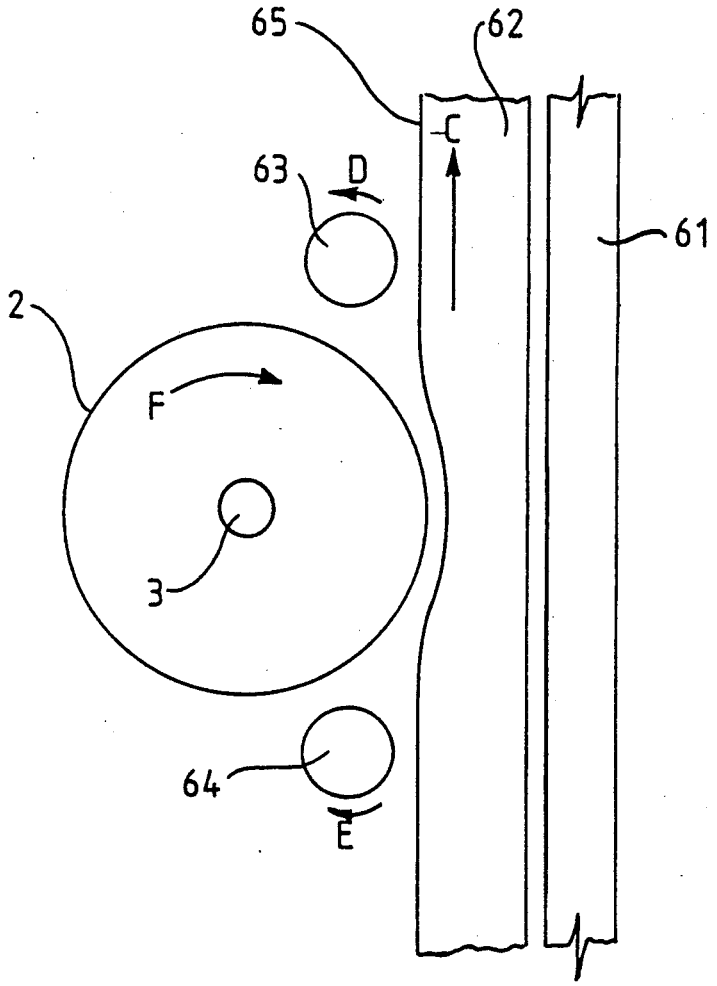
FIG. 1 is a side view of the present invention in operational mode.

Referring to the drawings, and specifically FIGS. 2, 4, 5 and 6, the improved fleshing machine includes a roller 2 rigidly attached to a horizontal axle 3, and a driving means 4 attached to the axle 3. A series of V shaped lines 5 of slots 6 (FIG. 4) are evenly spaced about the circumference of the roller 2. The lines 5 extend along substantially all the length of the roller , 2. The base of the V shape of each line 5 points in the direction of rotation of the roller 2 and is approximately at the centre of the length of the roller 2. Each limb of the V is at an angle of approximately 45 degrees to the horizontal. The spacing and number of lines 5 are such that the weight and configuration of the roller 2 is approximately uniform over any cross-section taken through the roller 2 on a plane perpendicular to the axis of rotation of the roller 2.

Figure 4:
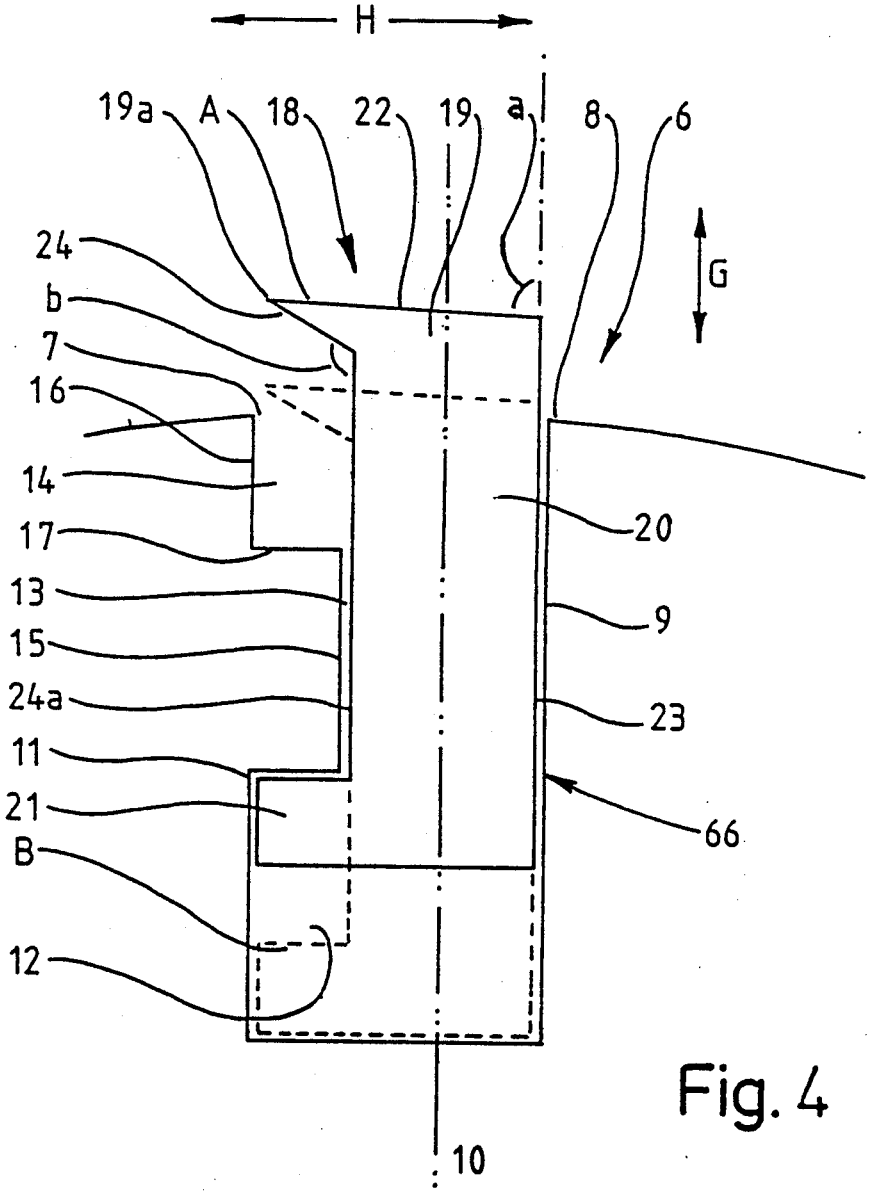
FIG. 4 is a sectional view along the line 4–4 of FIG. 2, showing the slot and a knife.
Figure 5:
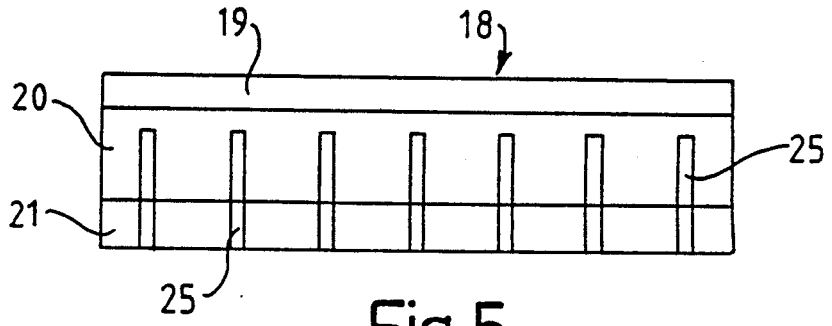
FIG. 5 is a side view of the FIG. 4 knife, the knife being flattened.

Referring to FIG. 4, each slot 6 is shaped so as to have two parallel edges 7, 8 opening onto the surface of the roller 2. Each slot 6 is contiguous with a cavity 66, the back wall 9 of which is straight and is substantially parallel to a radial axis 10. For the purposes of this description said radial axis 10 is defined as an axis perpendicular to the axis of rotation of the roller 2 and which passes through the axis of rotation of the roller 2 and through the centre of the slot 6, on any cross-section taken through the roller 2 on any plane perpendicular to the axis of rotation of the roller 2. The parallel edges 7, 8 are approximately parallel to the respective limb of the respective line 5.

The front wall 11 of each cavity 66 is shaped so as to define a cuboid cavity 12, a channel portion 13 and a cut away portion 14. The wall 15 of the channel portion 13 is substantially parallel with the back wall 9. The cut away portion 14 may include two walls (16, 17) at right angles to each other (as shown in FIG. 4). Alternatively the cut away portion 14 may be a straight wall to produce a chamfer edge of the front of the slot 6.

Each limb or branch (6*a*, 6*b*) of each slot 6 (FIG. 3) may contain one knife 18 (FIG. 4) or a plurality of knives 18 along the length of each limb (6*a*, 6*b*). Each knife 18 comprises a shaped cutting head 19, a shank 20 and a base 21 (as shown in FIG. 4).

The cutting head 19 includes a tapered tip 19*a* the top 22 of which is set at an angle (a, FIG. 4) to the back 23 of the knife 18. Angle a is close to 90 degrees and is preferably 80 degrees. The underside 24 of the tip 19*a* is set at an angle (b, FIG. 4) to the front 24*a* of the shank 20 of the knife 18. Angle b is preferably 135 degrees. The front 24*a* of the shank 20 is substantially parallel with the back 23 of the knife 18. It has been found that these angles produce good results when the machine is in operation.

The base 21 of the knife 18 is approximately rectangular in cross section, and positioned relative to the shank 20 such that the back 23 of the knife 18 is straight.

To fit into a slot 6 and cavity 66 each knife 18 has a slight spiral twist (not shown) along the length of each knife 18. Each knife 18 is a loose fit when in position in a slot 6 and cavity 66. Flexing slots 25 (FIG. 5) are cut into the base 21 and part of the length of the shank 20 of each knife 18 in order to enable to the spiral twist to be added to each knife 18 and to permit each knife 18 a degree of flexibility along the length of the knife 18 when the machine is in operation.

When each knife 18 is positioned in a slot 6 and cavity 66 and the machine is not in operation, the back 23 of the knife 18 is substantially parallel with the back wall 9 of the cavity 66. The shapes and proportions of the cuboid cavity 12 of the cavity 66, and base 21 and shank 20 of the knife 20 are such that the knife 18 is capable of limited movement (shown by double-headed arrow G, FIG. 4) in a plane parallel with the radial axis 10 of the slot 6. Thus the knife 18 may move from an "extended" position A (as shown in solid lines on FIG. 4) to an "at rest" position B (as shown in dotted lines on FIG. 4). In the at rest position B the head 19 may protrude from the surface of the roller 2 (as shown, B, FIG. 4) but preferably does not.

In operation the front wall 15 and channel 13 of the cavities 66 act as a guide to the movement of the knife 18. The front wall 15 is of a sufficient height to stop the knife 18 tipping too far and out of the slot 6 in the plane represented by the double headed arrow H. Tipping of the knife 18 when the machine is in operation may be further prevented by altering the shape and configuration of the cuboid cavity 12 and channel 13, and the base 21 and shank 20 of the knife 18, e.g. both the cuboid cavity 12 and channel 13, and base 21 and shank 20 of the knife 18 may be an inverted T-shape in cross section.

Figure 6:
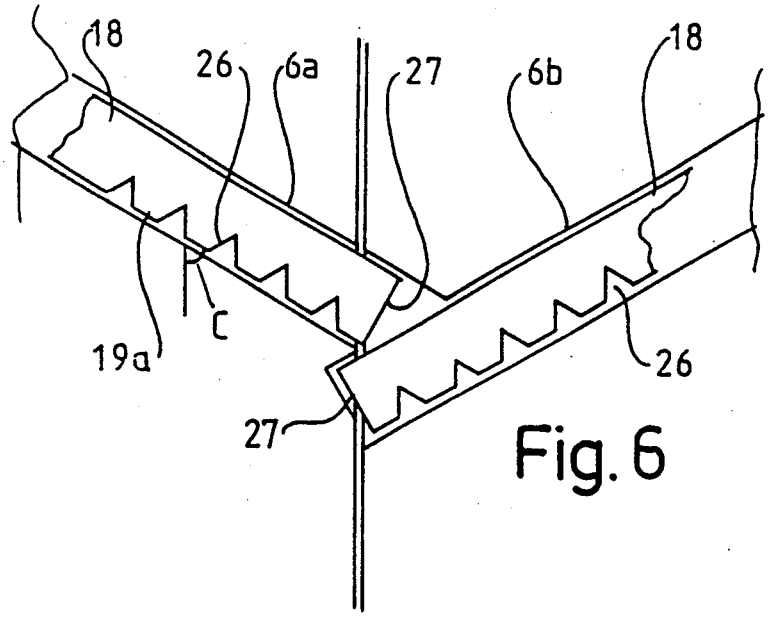
FIG. 6 is an enlarged plan view of a portion of the FIG. 2 showing.

As shown in FIG. 6, the tip 19*a* of the cutting head 22 of each knife 18 may contain notches 26 along the length of the tip 20. Operation of the machine has shown that the angle (c, FIG. 6) of each side of each notch 26 relative to the tip 19*a* should be approximately 45 degrees for efficient operation.

Operation of the machine has also shown that good results are produced by a roller 170 mm in diameter with six or ten equispaced lines (5, FIG. 2) of slots and with the height of the knife 18 being in the range 30–40 mm. Preferably the height is 35 mm. The amount of movement of the knife in the direction of the radial axis 10, under these conditions, is approximately 5–6 mm. In the at rest position (B, FIG. 4) the knife 18 , protrudes approximately 2 mm above the surface of the roller 2.

Figure 3:
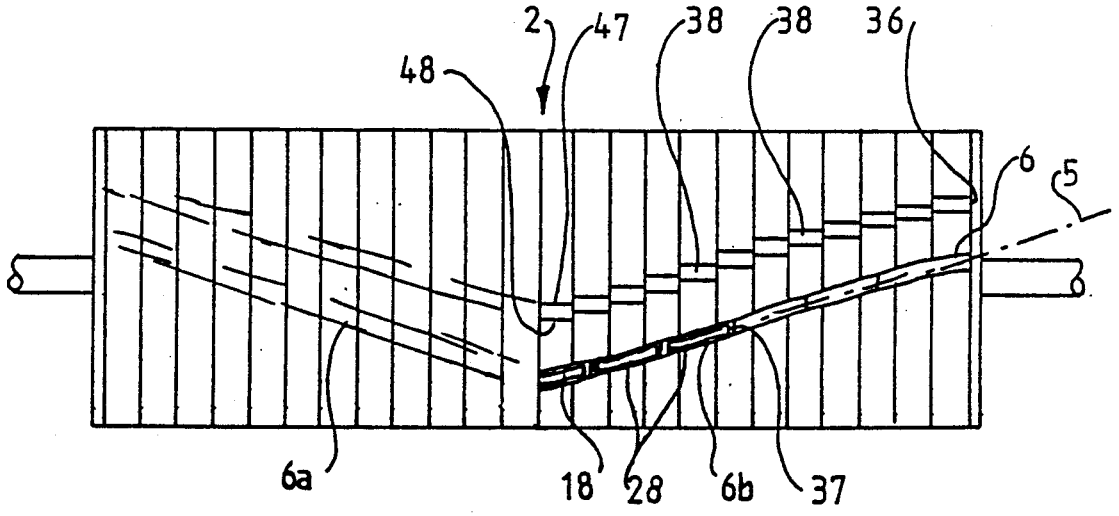
FIG. 3 is a view in plan of a second embodiment of the roller shown in association with the knives of the invention.

Referring to FIG. 3, a second embodiment of the roller 2 includes two further embodiments of the slots (6, 36) and knives (28, 38).

In the second embodiment of the slots and knives (6, 28), the slots 6 and cavities 66 are identical to the above described slots 6 and cavities 66. The cavities 66 may contain one knife 28 along each of the limbs (*6a*, *6b*) or a plurality of knives 28. A cross-sectional shape of each knife 28 is substantially the same as the above described knife 18, except for the ends of each knife. On each knife 18 the ends 27 (FIG. 6) of each knife 18 are at right angles to the sides of the knife 18. In the embodiment shown in FIG. 3, the ends 37 of each knife 28 are slanted relative to the sides of the knife 28. When each knife 28 is positioned in a slot 6, the plane of the ends 37 of each knife 28 is substantially parallel to the cross-sectional plane of the roller 2 perpendicular to the axis of rotation of the roller 2.

In a second embodiment of the slots 36 and third embodiment of the knives 38 (FIG. 3), each line 5 of the slots 36 is V shaped. Each slot 36 has edges (47, 48) substantially parallel with the axis of rotation of , the roller 2. The opening of each slot 36 on the surface of the roller 2 is rectangular. Each cavity 66 for each slot 36 contains one knife 38. The shape and configuration of the channel, back and cuboid cavity of each cavity 66 for each slot 36 is the same as the above described channel 13, back 9 and cuboid cavity 12 of each cavity 66. The shape and configuration of the shank and base of the knife 38 is the same as the shape and configuration of the shank 20 and base 21 of the above described knife 18.

Figure 7:
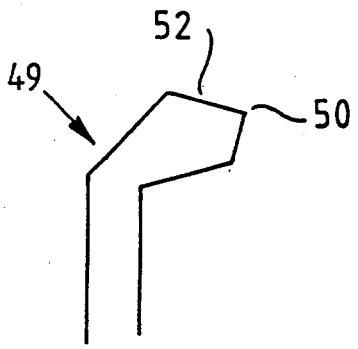
FIG. 7 is a side view of another embodiment of the knife of the invention.
Figure 8:
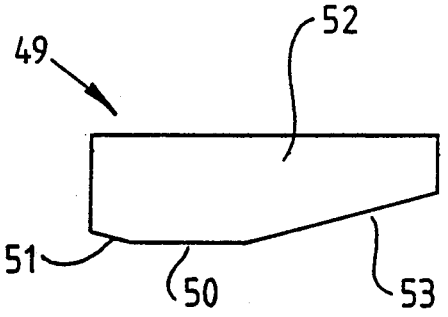
FIG. 8 is a top view of the FIG. 7 knife.

The cutting head 49 of each knife 38 is shown in FIGS. 7 and 8. The top 52 of the head 49 is chamfered at an angle to the tip 50. When the knife 38 is viewed from above (FIG. 8) the tip 50 is cut away at an angle to each side (51, 53). The cut away portions (51, 53) are necessary to prevent the edges of the knife 38 from being caught in holes or on protrusions on the pelt and either exacerbating the fault on the pelt or being unable to disengage therefrom.

Figure 9:
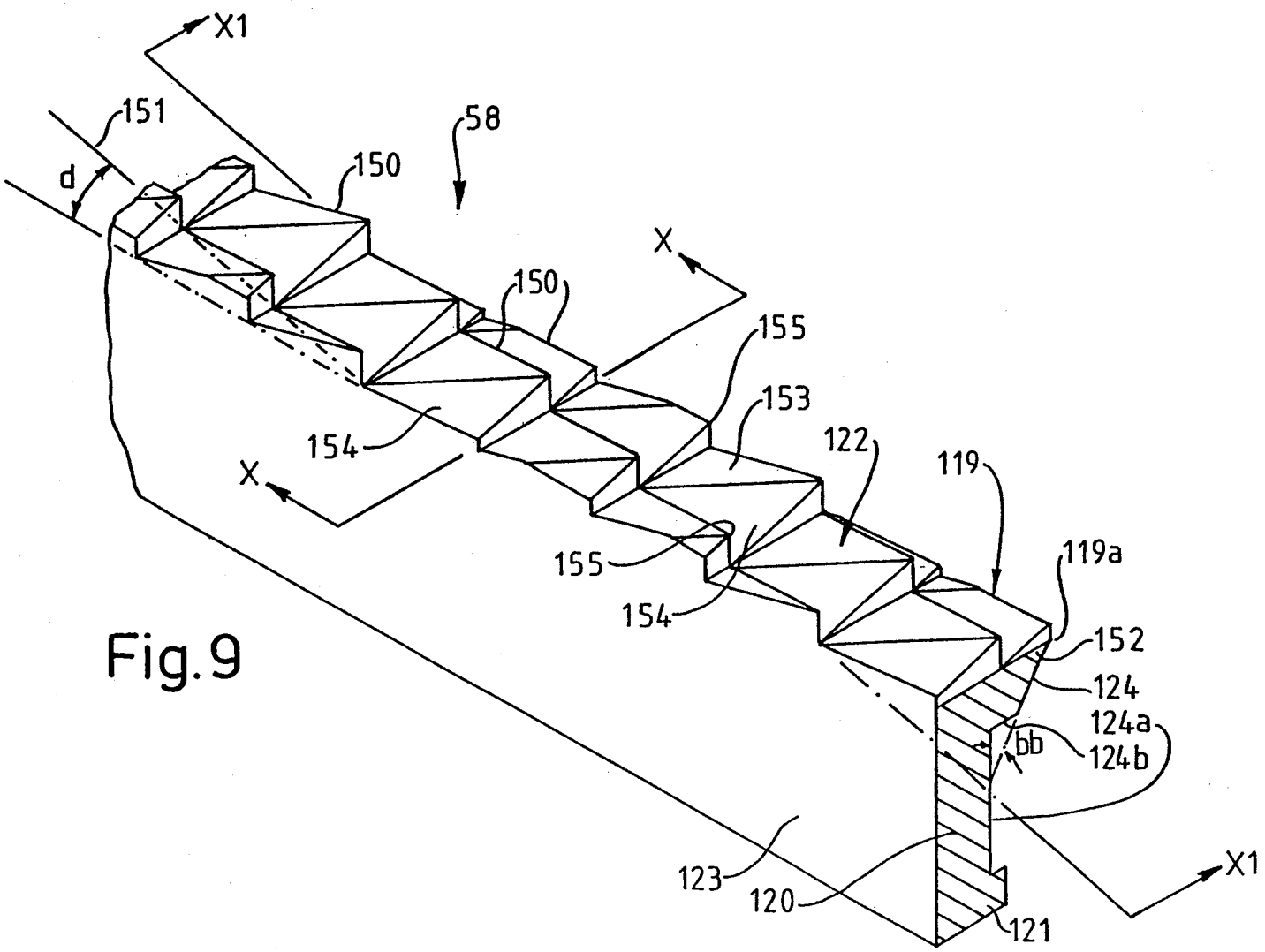
FIG. 9 is a partial perspective view of another embodiment of a knife of the invention.
Figure 10:
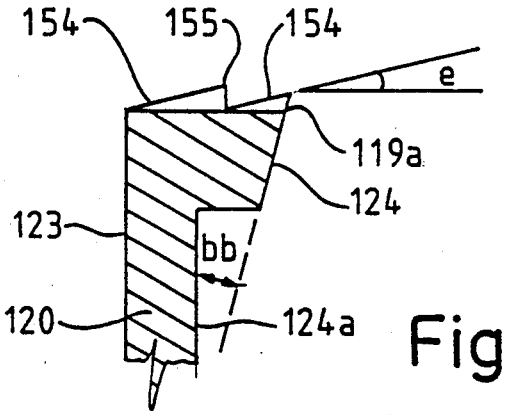
FIG. 10 is a sectional view along the line x—x of FIG. 9.
Figure 11:
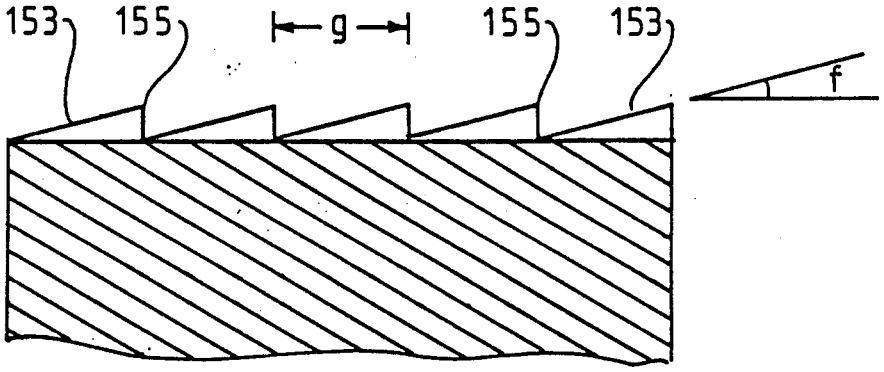
FIG. 11 is a sectional view along the line xi—xi of FIG. 9.

Referring to FIGS. 9–11, another embodiment of a knife 58 of the present invention is thereshown. Each knife 58 includes a shaped cutting head 119, a shank 120 and a base 121 (FIG. 9).

The cutting head 119 includes a tip 119*a* the top 122 of which includes a plurality of regularly spaced surfaces at an angle to and differing heights from the base 121 of the knife 58 (as described below).

The underside 124 of the tip 119*a* is set at an angle (bb, FIG. 9) to the front 124*a* of the shank 120 of the knife 58. Angle bb is in the range 20–25 degrees, preferably 24 degrees. The underside 124 of the tip 119*a* is cut away to form a substantially horizontal edge 124*b*. The front 124*a* of the shank 120 is substantially parallel with the back 123 of the knife 58.

The base 121 of the knife 58 is approximately rectangular in cross-section and positioned relative to the shank 120 such that the back 123 of the knife 58 is straight. The dimensions of the base 121 are such that the tip 119*a* of the cutting head 119 is further from the back 123 of the knife 58 than is the front face of the base 121.

Flexing slots (not shown), identical to slots 25 (FIG. 5), are cut into the base 121 and part of the length of the shank 120 of each knife 58 in order to enable the spiral twist to be added to each knife 58 and to permit each knife 58 a degree of flexibility along the length of the knife 58 when the machine is in operation.

The positioning and movements of the knife 58 in each cavity 66 and slot 6 is as described above for the , first preferred embodiment of the knife 18.

The top 122 of the knife 58 includes a repeating pattern of regularly spaced surfaces to provide a plurality of cutting edges 150 along the length of the knife 58 and one or more cutting edges 150 along the width of the top 122 of the knife 58. The base surface of the top 122 is indicated, in section, as numeral 152 on FIG. 9 and is a horizontal plane.

A plurality of cutting edges 150 are positioned along a plurality of lines 151 at an angle (d, FIG. 9) to a horizontal line on the base surface 152, said horizontal line lying along the length of the back 123 of the knife 58. The angle d is in the range 13–16 degrees, preferably 14 degrees. The lines 151 of cutting edges 150 are equidistantly spaced along the length of the knife 58.

Each knife 58 includes a plurality of surfaces 153 cut at an angle f (FIG. 11) to a horizontal line on the base surface 152, said horizontal line being perpendicular to the back 123 of the knife 58 . Said angle f being measured at right angles to the respective line 151 and from the base surface 152 (FIG. 9) of the top 122 of the knife 58.

Each knife 58 further includes a plurality of surfaces 154. Each surface 154 slopes from a line 151 (FIG. 8) to the respective surface 153 at an angle e as measured from the base surface 152 (FIG. 10). Angle f is approximately 12 degrees. The angle e is preferably in the range 14–17 degrees.

Thus each cutting edge 150 has an apex 155 and two surfaces 153, 154 sloping away from the apex 155 at angles e and f to the base surface 152. The height of the apex 155 for each cutting edge 150 is identical. The position of the apex 155 for each cutting edge 150 will depend on the distance of the apex 155 along the respective line 151 from the start (or end) of the line 151 on the base surface 152 of the top 122 of the knife 58.

In practice it has been found that the best results are produced with the following dimensions: the distance between adjacent lines 151 being 10 mm; the distance between adjacent apices (in plane, g, FIG. 11) being 10 mm; the height of each apex 155 above the base surface 152 being in the range 2–3 mm; and the width of the base surface 152 being 12 mm.

In practice it has also been found that the best way to construct the top 122 of the knife 58 is by two basic operations on the top 122 with the use of a milling machine, or other known machine of similar type. The knife 58 is set in the machine at the appropriate angle for the milling tool to mill down lines 151 at the angle e. The knife 58 is afterwards set in the machine at the appropriate angle for the milling tool to mill surfaces 153 at angle f at equidistant intervals down the length of the knife 58.

Figure 2:
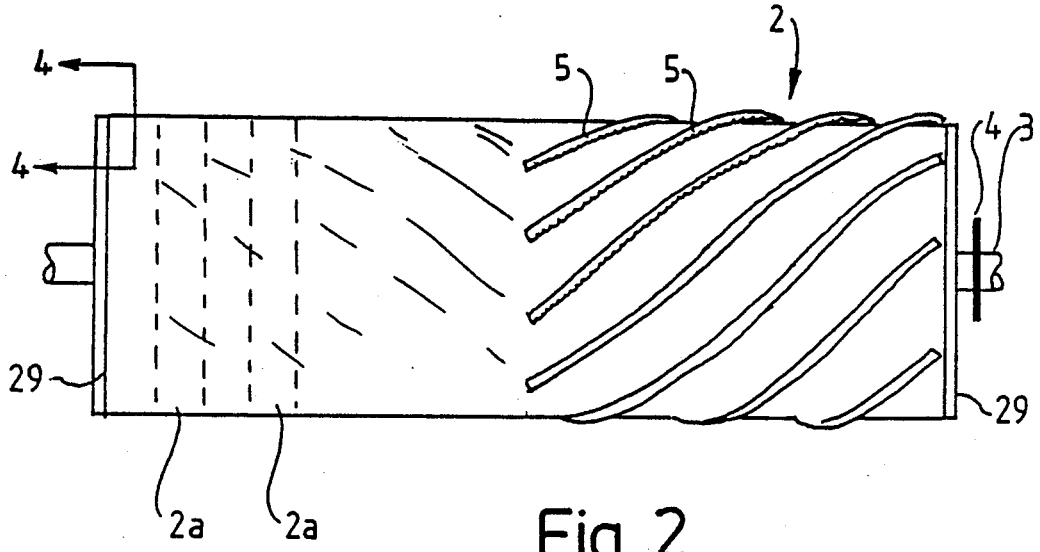
FIG. 2 is a view in plan of a roller of the invention.

The roller 2 may be formed from any rigid plastics material which is capable of being machined e.g. a high molecular weight polyethylene plastics, or from a metal, e.g. stainless steel. The roller 2 may be formed from one piece of material or may be formed from a series of annuli (*2a*, FIG. 2) of the material, all annuli being of equal thickness. The annuli may be rigidly held on the axle 3 by known means, e.g. a key slot guide on the axle 3 (not shown) and a guide bar 29 at each end of the roller 2 (FIG. 2). The use of annuli is of advantage when forming the slots (6 or 36) in the roller 2 and in replacing worn parts.

The knives (18, 28, 38 or 58) may be made from any plastics material which is slightly flexible, machinable and non-compressible, e.g. a high molecular weight polyethylene plastics which may, if desired, include ceramic beads for durability of the plastics material. Alternatively, the knives may be made from a metal e.g. light steel. If a metal is used, it should be light enough in weight that the knives do not hit the pelt with enough force to cause damage to the pelt , and to cause undue wear to the slots of the roller 2. Any such metal must also be capable of a slight degree of flexibility for the same reason.

Referring to FIG. 1 the fleshing machine also includes a board chain supporting means of known type with board supports 61 over which a pelt 62 can be hung, and two contrary motion spreader rollers (63, 64). The two spreader rollers are positioned one above (63) and one below (64) the roller 2 and touching the pelt 62. The axes of rotation of the spreader rollers 63, 64 are substantially parallel with the axis of rotation of the roller 2. Each of the spreader rollers 63, 64 is fitted with V shaped grooves (not shown) running towards the centre of the length of the spreader rollers 63, 64. Preferably, the rollers are faced with a plastics material which may be identical to the material of the roller 2. Alternatively, if desired, the spreader rollers 63, 64 may be of open wire mesh or any other suitable material and surface configuration.

Alternatively, if desired, the upper spreader roller 63 may be replaced by two spreader rollers (not shown) set in a V shape, the two spreader rollers being positioned in a plane parallel with the axis of rotation of the roller 2 and touching the pelt 62 along all the length of the two spreader rollers.

The axle 3 is rigidly secured to a roller mounting (not shown) which is fixed in spatial relationship to the board chain supporting means. If so desired, the securing means may be adjustable so that minor adjustments can be made to the said spatial relationship of the roller 2 and the board chain. The roller mounting may also be constructed such that the roller 2 may be removed from the roller mounting for cleaning and replacement of worn parts of the roller 2 and knives.

Experiment has shown that good results are achieved when the roller 2 is rotating at between 1500 to 2500 r.p.m. The driving means (not shown) for the roller 2 may be an electric motor or other known means. Experiment has shown that a 25 h.p. electric motor is needed to rotate a roller of approximately 1.5 metres in length at between 1500 to 2500 r.p.m.

The above described fleshing machine works as follows and is described with reference to the first preferred embodiments of the knife 18 and roller 2: a pelt 62 is draped flat over a board support and backing board 61. A board chain for driving the board support and driving means for the roller 2 are set in motion. The board chain operation moves the pelt 62 in an upwards direction (as shown in Arrow C FIG. 1) past the roller 2. The motion of the roller 2 causes the knives 18 to move from the at rest position (B, FIG. 4) to the extended position (A, FIG. 4) under the action of centrifugal force. The roller 2 is sufficiently wide that the knives 18 will clean the pelt 62 over its full width on one pass.

The spreader rollers 63, 64 rotate inwards towards each other (as shown by arrows D and E, FIG. 1). As the pelt 62 moves between the spreader rollers 63, 64 it is slightly stretched.

As the roller 2 rotates (in the direction indicated by arrow F, FIG. 1) the knives 18 come into contact with the surface 65 of the pelt 62 such that the tapered tip 19*a* of each knife 18 contacts the pelt 62 at substantially a right angle to the adjacent surface 65 of the pelt 62. The action of the knives 18 is an almost constant plucking action, pulling flesh and membranes away from the surface 65 of the pelt 62.

Should any knife 18 meet an obstruction on the surface 65 of the pelt 62 (e.g. due to lumps of matting on the reverse side), the obstruction causes the knife 18 to be pushed towards the at rest position until the knife 18 is passed the obstruction.

This motion, the small lateral motion in the direction of the surface of the pelt (permitted by the loose fitting of the knives 18 in the slot 6 and cavity 66, FIG. 4), and the flexing of the knives 18 allowed by the material of the knives 18 and the shape and configuration of the slots 25 (in the base 21) and shank 20 of the knives 18, all allow the knives to meet all the surface 65 of the pelt 62 with an approximately constant force. Thus, when the knives meet obstructions (as described above), holes, tears or cuts, there is sufficient flexibility in the knives 18 themselves and in their motion relative to the roller 2, that any existing faults on the surface 65 of the pelt 62 are not exacerbated.

The rotation of the roller 2 and the motion of knives 18 act to eject the bulk of the removed fat and membranes, so that the roller 2 is largely self cleaning. If so desired, a water or air jet (not shown) can be used to clean the roller 2 and knives 18 either continuously or periodically, whilst the roller 2 is in operation.

It will be appreciated that whilst the operation of the invention has been described with reference to the first embodiment of the knives 18 and of the roller 2, the fleshing machine operates in the same manner with the second embodiment of the knives (28) and first embodiment of the roller 2, or with the third embodiment of the knives (38) and second embodiment of the roller 2 (FIG. 3), or with the fourth embodiment of the knives 58 and first embodiment of the roller 2, or other appropriate combinations.

If so desired, V shaped lines of slots, and cavities with spacers (not shown) may be included as additions to the lines of slots and cavities and knives or as a replacement for alternate lines. Each spacer is of the same configuration as any of the above described embodiments of the knives, the only difference being that each spacer has a blunt edge at the front of the cutting head 19 (FIG. 4) and does not provide any plucking of fat or membranes from the surface of the pelt.

We claim:

1. An improved roller for a fleshing machine, the machine comprising: a supporting means for supporting or holding a hide or pelt; a roller of a fixed position type and being capable of rotation about an axis, driving means for rotating the roller about the axis; and means to produce relative movement between the hide or pelt and the roller; wherein the roller improvement comprising:

the roller containing a plurality of shaped cavities with each cavity extending into the roller from an opening on the surface of the roller;

a plurality of shaped knives, one or more of the knives being contained within each cavity, each knife having a shaped cutting head which in used protrudes from the surface of the roller, and a shank and a base shaped such that each knife is capable of limited reciprocal movement in a direction perpendicular to the axis of the roller, each cavity being shaped so as to permit the limited movement of each knife and to retain the base of the knife within the cavity when the machine is in operation or stationary;

the positioning and shape of the cavities within the roller and the shape of the knives being such that, in operation, the cutting head of each knife contacts the surface of the hide or pelt with an approximately constant force and at approximately a right angle to the surface of the hide or pelt as the surface passes the roller and such that each cutting head is also capable of limited movement in a plane substantially perpendicular to a plane of reciprocal movement of the knife.

2. In the improved roller as claimed in claim 1 wherein the openings of the cavities on the surface of the roller are positioned in a plurality of lines of openings extending a long the roller length, the lines being evenly spaced about the circumference of the roller surface.

3. In the improved roller as claimed in claim 2 with the openings defining a slots, the slots forming a plurality of "V" shaped lines with the base of the "V" shape of each line pointing int the direction of motion of the roller, each line having two limbs of slots.

4. An improved roller as claimed in claim 3 wherein each slot includes two parallel edges opening onto the surface of the roller, and wherein each cavity includes: a straight back wall substantially parallel to a radial axis; a front wall; and a bottom wall; the walls defining a cuboid cavity, a channel portion and a cut away portion, the wall of the channel portion being substantially parallel with the back wall; the tops of the walls and of the cut away portion being contiguous with the parallel edges of the respective slot.

5. In the improved roller as claimed in claim 4 wherein the edges of each slot are approximately parallel with the respective limb of the respective line.

6. In the improved roller as claimed in claim 5 wherein the slots on each limb of each line of slots are contiguous so that each limb of each "V" shaped line provides one long cavity.

7. In the improved roller as claimed in claim 4 wherein the edges of each slot are approximately parallel with the axis of rotation of the roller.

8. In the improved roller as claimed in claim 6 wherein each limb of each "V" shaped line of slots contains one knife the length of which is approximately equal to the length of each limb

9. An improved knife for a fleshing machine, the machine comprising: a supporting means for supporting or holding a hide or pelt; a roller which is a fixed position roller and which is capable of rotation about an axis, the roller containing a plurality of shaped cavities, each cavity extending from an opening on the surface of the roller into the roller; driving means for rotating the roller about the axis; means to produce relative movement between the hide or pelt and the roller; a plurality of shaped knives; the improvement comprising:

one or more knives being contained within each cavity, each knife having a shaped cutting head which in use protrudes from the surface of the roller, and a shank and a base such that each knife is capable of limited reciprocal movement in a direction perpendicular to the axis of the roller, each cavity being shaped so as to permit limited movement of each knife and to retain the base of the knife within the cavity when the machine is in operation or stationary;

the positioning and shape of the cavities within the roller and the shape of the knives being such that, in operation, the cutting head of each knife contacts the surface of the hide or pelt with an approximately constant force and at approximately a right angle to the surface of the hide or pelt as the surface passes the roller and such that each cutting head is also capable of limited movement in a plane substantially perpendicular to the plane of reciprocal movement of the knife.

10. An improved knife as claimed in claim 9 wherein:

the openings of the cavities on the surface of the roller being slots and being positioned in a plurality of lines of openings extending along the length of the roller, the lines being evenly spaced about the circumference of the roller surface;

the slots forming a plurality of "V" shaped lines, the base of the "V" shape of each line pointing in the direction of motion of the roller, each line having two limbs of slots; and the slots on each limb of each line of slots being contiguous so that each limb of each "V" shaped line provides one long cavity.

11. An improved knife as claimed in claim 9 wherein the cutting head of each knife a tip with a top surface, the top surface being chamfered at an angle to the tip and cut away at each side of the tip.

12. An improved knife as claimed in claim 10 wherein the shaped cutting head of each knife includes a tapered tip, the top of which is set at a first angle to the back of the knife, the underside of which is set at a second angle to the front of the shank of the knife, the front of the shank being substantially parallel with the back of the knife.

13. An improved knife as claimed in claim 12 wherein the first angle is in the range of 80 to 90 degrees.

14. An improved knife as claimed in claim 13 wherein the second angle is approximately 135 degrees.

15. An improved knife as claimed in claim 14 wherein each knife further includes a plurality of notches evenly spaced along the length of the tip of the knife.

16. An improved knife as claimed in claim 9 wherein the shaped cutting head of each knife includes a tip with an underside and a top, the top including a repeating pattern of a plurality of regularly spaced surfaces at an angle to and at differing heights from a base surface of the top, the base surface being at right angles to the back of the knife.

17. An improved knife as claimed in claim 16 wherein (a) the underside of the tip is set at a first angle to the front of the shank, (b) the regularly spaced surfaces providing a plurality of cutting edges along the length of each knife;

(c) the regularly spaced surfaces providing one or more cutting edges across the width of the top of the knife;

(d) the plurality of the cutting edges being positioned along a plurality of lines set at a second angle to a first horizontal line of the base surface, the first horizontal line being parallel with the back of the knives;

(e) each surface being cut at a third angle to a second horizontal line on the base surface, the second horizontal line being perpendicular to the back of the knife; and (f) each surface sloping from the second horizontal line to the respective cutting edge at a fourth angle, the fourth angle being measured at right angles to the second horizontal line.

18. An improved knife as claimed in claim 17 wherein:

(a) the first angle is in the range 20–25 degrees;

(b) the second angle is in the range 13–16 degrees;

(c) the third angle is in the range 14–17 degrees; and (d) the fourth angle is approximately 12 degrees.

19. An improved knife as claimed in claim 18 wherein each knife has a part-spiral twist along the axis of the knife substantially parallel to the back of the edge of the shaped cutting head.

20. An improved knife as claimed in claim 19 wherein each knife includes a plurality of evenly spaced flexing slots which are cut into the base and part of the length of the shank of each knife.

21. An improved knife as claimed in claim 17 wherein each knife includes a plurality of evenly spaced flexing slots which are cut into the base and part of the length of the shank of each knife.

* * * * *